US006518857B1

(12) United States Patent
Hattori et al.

(10) Patent No.: US 6,518,857 B1
(45) **Date of Patent: *Feb. 11, 2003**

(54) MULTIMODE DIELECTRIC RESONATOR APPARATUS, FILTER, DUPLEXER, AND COMMUNICATION APPARATUS

(75) Inventors: Jun Hattori, Takatsuki (JP); Shin Abe, Muko (JP); Hiroki Wakamatsu, Kyoto (JP); Tomoyuki Ise, Nagaokakyo (JP)

(73) Assignee: Murata Manufacturing Co. Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/718,555

(22) Filed: Nov. 22, 2000

(30) Foreign Application Priority Data

Nov. 24, 1999 (JP) ..... 11-333405

(51) Int. Cl.[7] ..... H01P 7/10; H01P 1/20
(52) U.S. Cl. ..... 333/134; 333/228; 333/219.1
(58) Field of Search ..... 333/134, 219, 333/219.1, 202, 228

(56) References Cited

U.S. PATENT DOCUMENTS 5,059,929 A * 10/1991 Tanaka ..... 333/219.1
5,859,574 A * 1/1999 Schmitt ..... 333/202
6,104,261 A * 8/2000 Sonoda et al. ..... 333/202

FOREIGN PATENT DOCUMENTS

EP 1014474 A1 6/2000 ..... H01P/7/10
WO WO9912225 3/1999 ..... H01P/7/10

OTHER PUBLICATIONS

Patent Abstracts of Japan, Jun. 16, 1995.

Ji–Fuh Liang et al., Mixed Modes Dielectric Resonator Loaded Cavity Filters, 1994, pp. 731–734.

Valérie Madrangeas et al., Analysis and Realization of L–Band Dielectric Resonator Microwave Filters, Jan. 1992, pp. 120–127.

* cited by examiner

*Primary Examiner*—Robert Pascal
*Assistant Examiner*—Dean Takaoka
(74) *Attorney, Agent, or Firm*—Dickstein, Shapiro, Morin & Oshinsky, LLP.

(57) ABSTRACT

A multimode dielectric resonator apparatus is configured such that a TM mode and a TE mode are transformed into multiplex modes, coupling between individual resonant modes can be easily made, and a large number of sequentially coupled stages can be obtained with a single dielectric core. In the multimode dielectric resonator apparatus, a dielectric core is configured of a plate-like TM-mode dielectric core portion and a TE-mode dielectric core portion protruding therefrom in the vertical direction, for example in a spherical shape. Five modes, namely a TMx mode, a TMy mode, a TEx mode, a TEy mode, and a TEz mode are used as multiplex modes. In addition, a filter and a duplexer use the multimode dielectric resonator apparatus, and a communication apparatus uses one or both of the filter and the duplexer.

11 Claims, 24 Drawing Sheets

MULTIMODE DIELECTRIC RESONATOR APPARATUS, FILTER, DUPLEXER, AND COMMUNICATION APPARATUS

CROSS-REFERENCE TO RELATED APPLICATION

This is related to Ser. No. 09/718,727 filed by the same inventors on even date herewith, titled MULTIMODE DIELECTRIC RESONATOR APPARATUS, FILTER, DUPLEXER, AND COMMUNICATION APPARATUS, the disclosures of which are incorporated by reference herein.

BACKGROUND OF THE INVENTION

1. Field of the Invention

The present invention relates to a multimode dielectric resonator apparatus that operates in multiple resonant modes, to a filter and a duplexer that include the resonator and to a communication apparatus that includes the filter and/or the duplexer.

2. Description of the Related Art

Conventionally, a dielectric resonator having a dielectric core arranged in a cavity uses a mode such as a TE01δ mode or a TM01δ mode. In a configuration of a multistage dielectric resonator apparatus formed using a plurality of the aforementioned dielectric resonators, a plurality of the dielectric cores are provided in a cavity.

In the aforementioned configuration using the single resonant mode generated in the single dielectric core, however, the overall size thereof is increased in proportion to the increase in the number of resonators. In addition, the plurality of dielectric cores must be positioned and fixed with high accuracy. This makes it difficult to manufacture dielectric resonator apparatuses, such as dielectric filters, having consistent characteristics.

In view of the above, the present applicant submitted Japanese Unexamined patent application Publication No. 11-145704, regarding a dielectric resonator apparatus in which, while only a single dielectric core is used, the multiplex number is increased. In the proposed dielectric resonator apparatus, at most six modes are generated and can be used. Specifically, with respect to resonant spaces represented by x, y, and z rectangular coordinates, the apparatus generates TMx, TMy, and TMz modes in which electric-field vectors extend toward the x, y, and z axes; and in addition, it generates TEx, TEy, and TEz modes in which electric-field vectors form loops in planes perpendicular to the x, y, and z axes. However, in connection with, for example, positions where coupling grooves are needed, the manufacture of the aforementioned dielectric resonator apparatus involves overcoming significant technical difficulties in order to couple the six individual modes to each other so that all the six modes can be used.

SUMMARY OF THE INVENTION

In view of the above, the present invention provides a multimode dielectric resonator apparatus that allows individual resonant modes to be easily obtained, and that allows a large number of resonant-mode sequentially coupled stages to be obtained with a single dielectric core.

The invention also provides a filter using the aforementioned multimode dielectric resonator apparatus.

The invention further provides a duplexer that uses the aforementioned multimode dielectric resonator apparatus.

The invention further provides a communication apparatus using one or more of the above filter and duplexer.

According to one aspect of the present invention, a multimode dielectric resonator apparatus comprises a dielectric core in a conductive cavity. The dielectric core comprises a multi-TM-mode dielectric core portion primarily for determining resonant frequencies of TM modes so that at least one of the TM modes resonates in an operating frequency band, and at least one other TM mode resonates at a frequency higher than the operating frequency band; and a multi-TE-mode dielectric core portion primarily for determining resonant frequencies of TE modes wherein all of the TE modes resonate in the operating frequency band.

More generally, the dielectric core comprises a multi-TM-mode dielectric core portion primarily for determining resonant frequencies of TM modes so that at least one of the TM modes resonates in an operating frequency band, and a multi-TE-mode dielectric core portion primarily for determining resonant frequencies of TE modes wherein at least two of the TE modes resonate in the operating frequency band.

According to the above-described construction, a plurality of TM modes and TE modes can be used, without being influenced by a TM mode which is set to a frequency higher than the operating frequency. Furthermore, a problem can be solved which occurs when one of three TM modes used is unnecessarily coupled to another resonant mode. In addition, predetermined resonant modes can be coupled together in a predetermined condition.

According to another aspect of the invention, in the multimode dielectric resonator apparatus, the TM-mode dielectric core portion is formed in a plate-like shape, the TE-mode dielectric core portion protrudes from a part of the TM-mode dielectric core portion, and the TM-mode dielectric core portion and the TE-mode dielectric core portion are integrated with each other. The TE-mode dielectric core portion may be substantially spherical, quasi-spherical, or ovoid, for example.

According to this construction, the resonant frequency of the TM modes in which the electric-field vectors extend in the thickness direction of the plate-like TM-mode dielectric core portion is arranged to be higher than the resonant frequency of the TM modes in which the electric-field vectors extend in the plane direction thereof, whereby the resonant frequency of the former TM mode is set to a frequency that is higher than the operating frequency band.

With this construction, without being influenced by the shape of the TM-mode dielectric core portion, the TE-mode dielectric core portion having the shape protruding from a part of the TM-mode dielectric core portion can be operated as a multi-TE-mode resonator. The protruding parts may have any shape as long as the five modes of interest (TMx, TMy, TMz, TEx, TEy) have substantially the same resonant frequency. For example, in a quintuple mode filter for the 2 GHz band, the respective resonant frequencies should be within about 0.1 MHZ of each other. In addition, since the TM-mode dielectric core portion and the TE-mode dielectric core portion are integrated with each other, the dielectric core can be easily manufactured, and furthermore, the dielectric core can be easily arranged in the cavity.

According to another aspect of the invention, a filter comprises the aforementioned multimode dielectric resonator apparatus and input/output structures coupled to predetermined resonant modes arranged therein. With this construction, the filter can be formed as a small and low-loss-type filter using multiple resonator stages. The filter thus formed has reduced inter-resonator coupling losses, increased Q values of the individual resonators, and uses the single dielectric core and the single cavity. More specifically, since inter-resonator coupling losses are reduced by using the multiplex resonant modes, and the dielectric core is provided in a central portion of the cavity, electromagnetic fields are concentrated at the dielectric core, conductor losses are reduced, and the Q values of the individual resonators are thereby increased. Therefore, by using the single dielectric core and the single cavity, a small and low-loss-type filter using multiple resonator stages can be provided.

In the filter of the present invention, the aforementioned input/output structures are coupled to TM modes, and further structures are provided for coupling TM modes and TE modes to each other and for coupling TE modes to each other. According to this construction, the input/output structures are securely coupled to electromagnetic fields of TM modes in which, as compared to the TE mode, a larger amount of the electromagnetic field is caused to leak to the outside of the dielectric core, whereby the coupling and the band width can be easily increased. In addition, with sequential coupling of the TE modes, the structure of the coupling structures is simplified, and the design thereof is therefore easy.

According to still another aspect of the present invention, a filter comprises the aforementioned multimode dielectric resonator apparatus, and either coaxial resonators or semicoaxial resonators that are coupled to predetermined modes, and input/output structures coupled to the resonators.

Generally, although secure coupling can be obtained with magnetic-field coupling, it is difficult to provide a coupling loop that couples only to one mode of a multimode dielectric resonator. According to the above-described construction, however, it is the semicoaxial resonators or coaxial resonators that are externally coupled, and secure coupling can thereby be obtained with coupling loops to increase the band width.

In addition, a spurious mode caused by the aforementioned multimode dielectric resonator is minimized by using the semicoaxial resonators or coaxial resonators, and the overall spurious-mode characteristics of the filter can thereby be improved.

Furthermore, since the input/output structures in the multimode dielectric resonator portion are miniaturized, direct passage of signals between the input and the output is reduced. This prevents deterioration in characteristics due to the direct passage of signals from occurring. More specifically, since the semicoaxial resonators or coaxial resonators need not be securely coupled, the input/output structures in the multimode dielectric resonator portion can be small, direct passage of signals between the input and the output is thereby reduced, and deterioration in characteristics due to the direct passage therefore does not occur.

According to still another aspect of the present invention, a duplexer comprises two of the above-described filters. This allows the duplexer to be small overall and to be of a low-loss type. The duplexer can be used as an antenna-sharing unit.

According to still another aspect of the present invention, a communication apparatus comprises at least one of the aforementioned filter and the aforementioned duplexer. The filter may be provided to filter transmission signals or reception signals in a high-frequency circuit. The duplexer may be provided as an antenna-sharing unit. This communication apparatus can be arranged to be small overall and to be of a low-loss type.

Other features and advantages of the present invention will become apparent from the following description of embodiments of the invention which refers to the accompanying drawings, in which like references denote like elements and parts.

BRIEF DESCRIPTION OF THE DRAWINGS

FIGS. 22A and 22B show an example of a filter using another quintuple mode resonator, wherein FIG. 22A is a plan view and FIG. 22B is a cross-sectional view taken at line B-B in FIG. 22A;

FIGS. 23A and 23B show an example of a configuration of a filter using semicoaxial resonators and the quintuple mode resonator, wherein FIG. 23A is a plan view and FIG. 23B is a cross-sectional view taken at line B—B in FIG. 23A;

DESCRIPTION OF EMBODIMENTS OF THE INVENTION

Referring to FIGS. 1 to 7B, a description will be given of a configuration of a multimode dielectric resonator apparatus according to an embodiment of the present invention.

Figure 1:
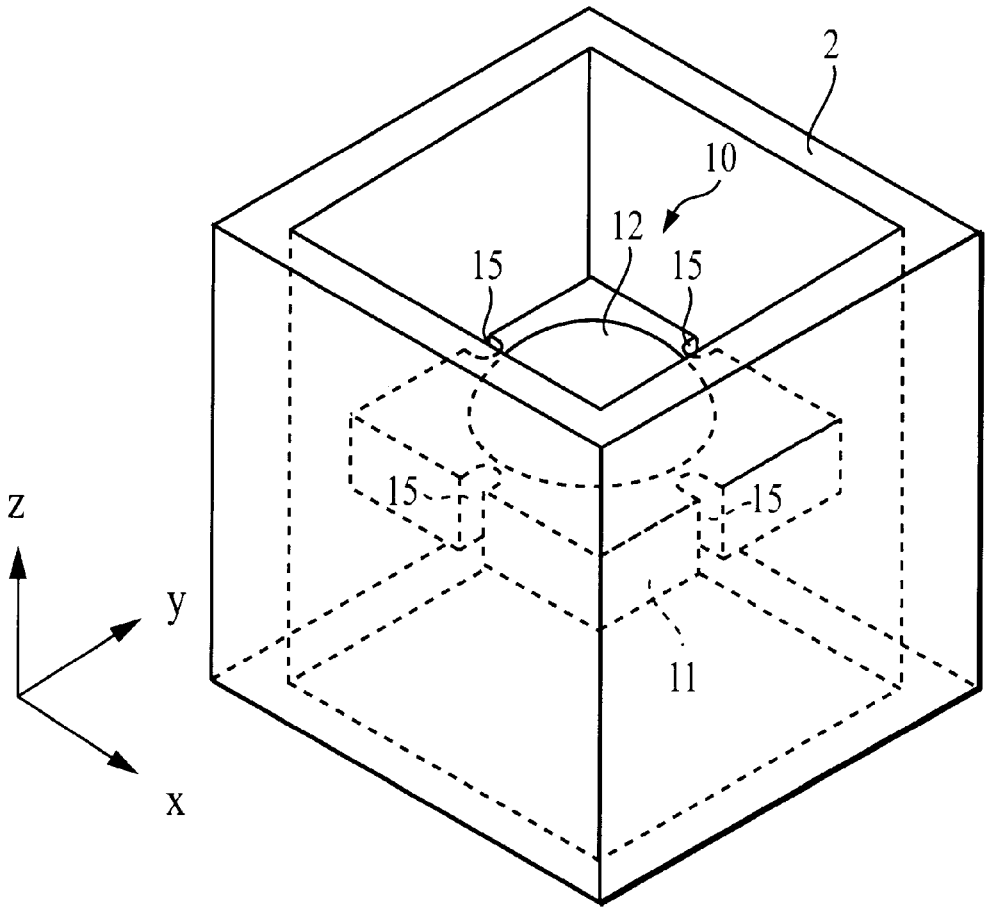
FIG. 1 is a perspective view showing a basic configuration of a multimode dielectric resonator apparatus according to an embodiment of the invention.

FIG. 1 is a perspective view of a basic configuration portion of the multimode dielectric resonator apparatus. Reference numeral 10 denotes a dielectric core, and reference numeral 2 denotes a cavity for housing the dielectric core 10. The dielectric core 10 is constituted of a plate-like TM-mode dielectric core portion 11 and a TE-mode dielectric core portion 12 protruding therefrom in the shape of part of a sphere. The cavity 2 comprises conductive films formed on peripheral surfaces of a ceramic four-sided housing-like member. On upper and lower opening faces of the cavity 2 are disposed either metal plates, or dielectric plates on which conductive films are formed, and a substantially parallelepiped shield space is thereby formed. In FIG. 1, support members for supporting the dielectric core 10 in the cavity 2 and input/output structures that perform input from and/or output of signals to the outside have been omitted to clearly show the arrangement of the structure of the dielectric core in the cavity.

Figure 2A:
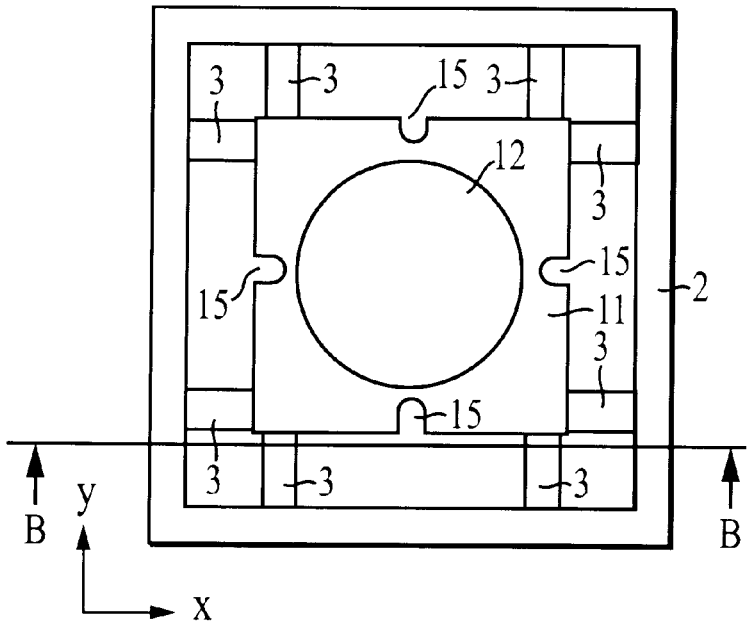
FIGS. 2A and 2B are a top view and a cross-sectional view, respectively, of the multimode dielectric resonator shown in FIG. 1.
Figure 2B:
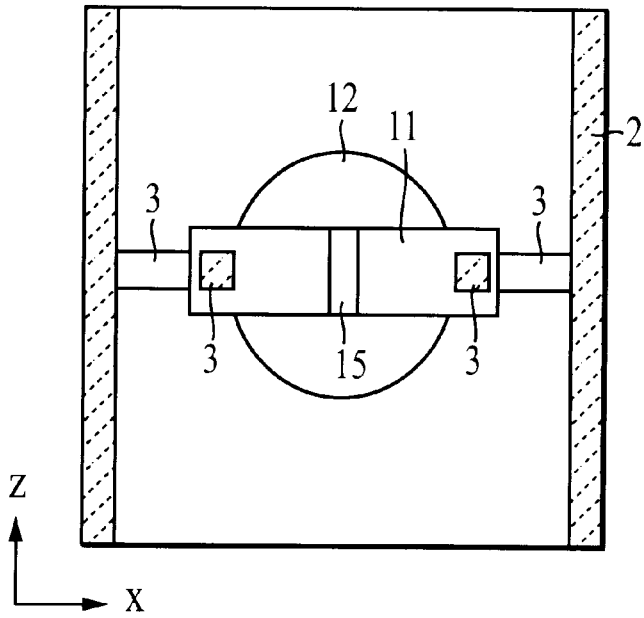

FIG. 2A is a top view of the multimode dielectric resonator apparatus shown in FIG. 1, and FIG. 2B is a cross-sectional view of portion B—B in FIG. 2A. In these figures, reference numeral 3 denotes individual support members for connecting the TM-mode dielectric core portion 11 of the dielectric core to inner wall faces of the cavity 2. The individual support members 3 are made of a material having permittivity lower than that of the dielectric core 10. An individual groove 15 is provided to shift a TEz-mode resonant frequency toward a higher frequency, as described below.

Figure 3A:
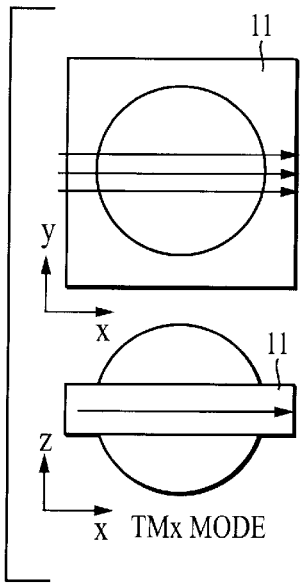
FIGS. 3A to 3E show electric-field distributions in individual modes.
Figure 3B:
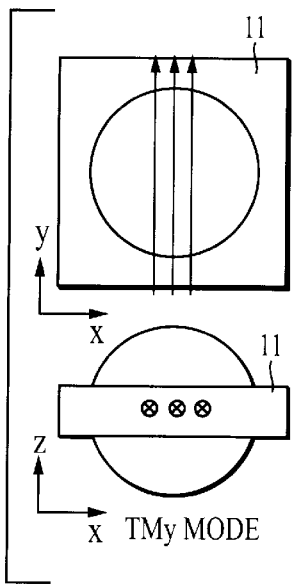
Figure 3C:
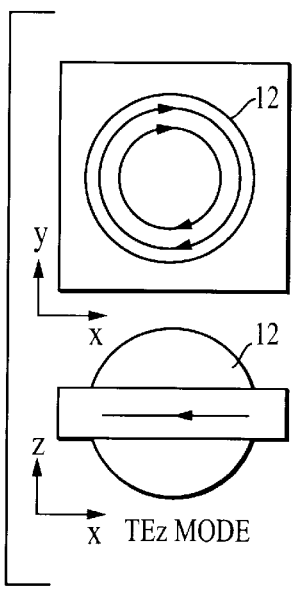
Figure 3D:
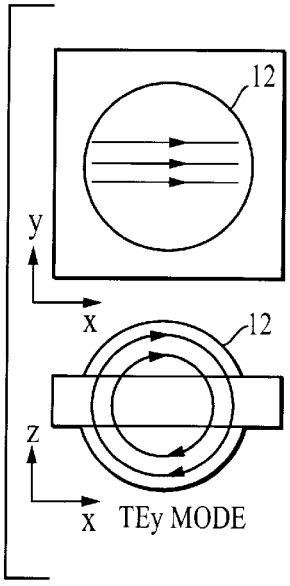
Figure 3E:
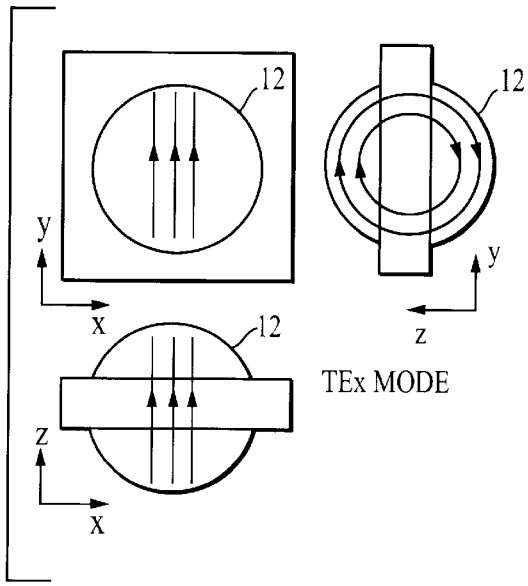

FIGS. 3A to 3E show five examples of resonant-mode electric field distributions that can exist in the multimode dielectric resonator apparatus. FIG. 3A shows a TMx mode, and FIG. 3B shows a TMy mode. Thus, in the TMx mode, electric-field vectors extend from one of the conductive films formed on the peripheral surfaces of the cavity 2 to the opposing one of the conductive films along the x-axis. Similarly, in the TMy mode, electric-field vectors extend along the y-axis. FIG. 3C shows a TEz mode, FIG. 3D shows a TEy mode, and FIG. 3E shows a TEx mode. In the TEz mode, electric-field vectors form loops in the plane direction perpendicular to the z-axis; in the TEy mode, electric-field vectors form loops in the plane direction perpendicular to the y-axis; and in the TEx mode electric-field vectors form loops in the plane direction perpendicular to the x-axis.

A TMz mode in which electric-field vectors extend along the z-axis is also generated. However, since the dimension in the thickness direction of the plate-like TM-mode dielectric core portion 11 is less than the dimensions in the other directions, the resonant frequency of the TMz mode is higher than the resonant frequencies of the other modes, i.e., higher than an operating frequency band.

Figure 4:
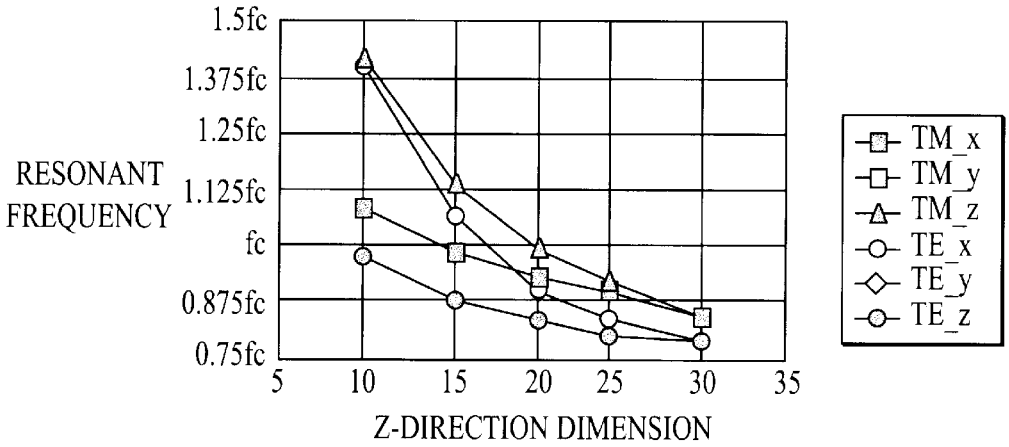
FIG. 4 is a graph showing the relationship between the thickness dimension of a plate-like portion of a dielectric core and the resonant frequency of each of the modes.
Figure 5:
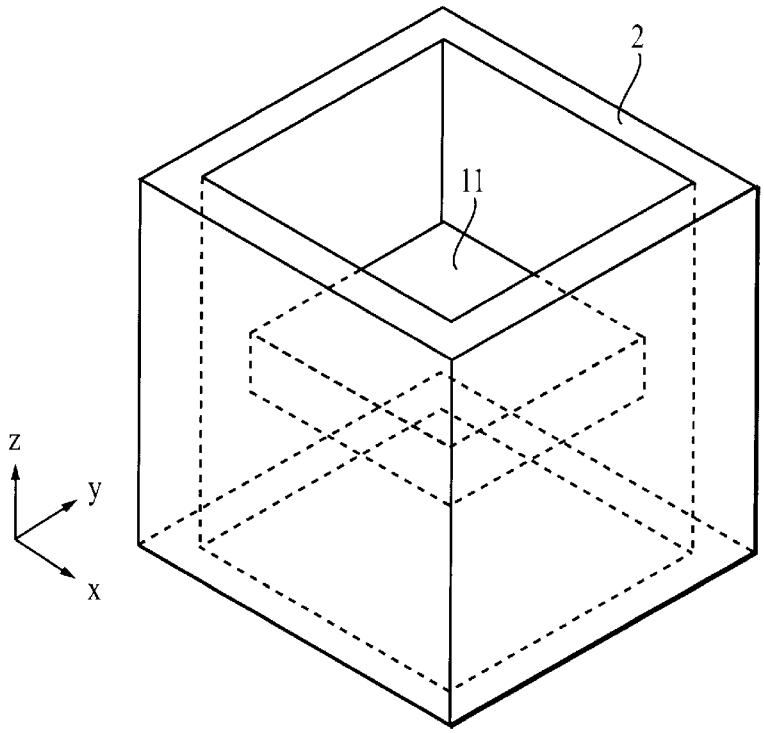
FIG. 5 is a perspective view showing a configuration of the dielectric resonator.

FIG. 4 shows variations in resonant frequencies of the above-described six resonant modes in response to variations in the z-direction dimension in a case where a square and plate-like dielectric core is used (i.e., where the TE-mode dielectric core portion 12 is removed from the structure shown in FIG. 1). FIG. 5 shows an example of the apparatus in the above case. In this case, the vertical width, the horizontal width, and the height of the cavity 2 are each 40 mm.

As shown in FIG. 4, by reducing the z-direction (thickness-direction) dimension of the dielectric core, the resonant frequency of the TMz mode can be set higher than the resonant frequencies of the TMx mode and the TMy mode. In FIG. 4, the marks indicating resonant frequencies of the TMx mode overlap with the marks indicating resonant frequencies of the TMy mode. Also, the marks indicating resonant frequencies of the TEx mode overlap with the marks indicating resonant frequencies of the TEy mode.

For example, by setting the widths of the dielectric core in the x-axis direction and the y-axis direction to 30 mm, and by making the width (thickness) in the z-axis direction 50% thereof or less (that is, 15 mm or less), the resonant frequency of the TMz mode can be made 10% or more higher than the resonant frequencies of the TMx mode and the TMy mode. To obtain ordinary filter characteristics to meet commercial requirements, the resonant frequencies of resonant modes other than the operating frequency band must be 10% or more separated from the operating frequency band. Therefore, the thickness dimension of the TM-mode dielectric core portion is preferably 50% of or less than the dimensions in the other two directions.

With the structure described above, however, the resonant frequency of either the TEx mode or the TEy mode also becomes higher. To solve this problem, the TE-mode dielectric core portion 12 protruding from the TM-mode dielectric core portion 11 is provided. Thereby, resonant frequencies of the TEx mode and the TEy mode are lowered so as to be within the operating frequency band.

Figure 6:
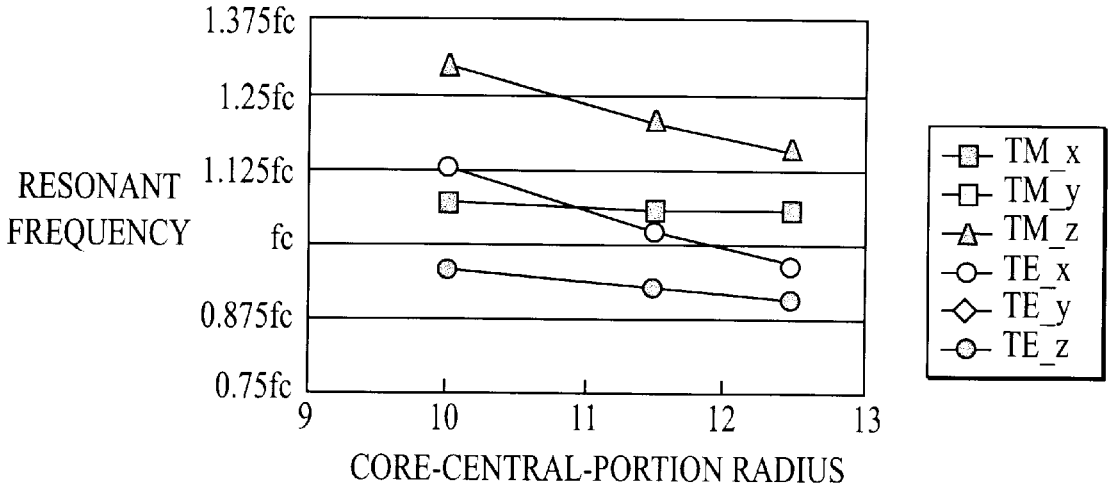
FIG. 6 is a graph showing the relationship between the size of a spherical portion protruding from the plate-like portion of the dielectric core and the resonant frequency of each of the modes.

FIG. 6 is a graph showing the variations in the resonant frequencies of the above-described six resonant modes in response to variations in the radius of the spherical portion, that is, the shape of the TE-mode dielectric core portion 12. As can be seen from the graph, in response to an increase in the radius of the spherical portion of the TE-mode dielectric core portion 12, the resonant frequencies of the TEx mode and the TEy mode decrease, whereas the resonant frequencies of the TMx mode and the TMy mode vary only slightly. (In FIG. 6, the marks indicating resonant frequencies of the TMx mode overlap with the marks indicating resonant frequencies of the TMy mode. Also, the marks indicating the resonant frequencies of the TEx mode overlap with the marks indicating the resonant frequencies of the TEy mode.) In this particular example, when the radius is about 11 mm, the TMx mode, the TMy mode, the TEx mode, and the TEy mode resonate at substantially the same frequency. Although the resonant frequency of the TMz mode is reduced by increasing the radius of the spherical portion, since it is preshifted to a high frequency, it does not influence the other modes.

In the TEz mode, since the electric-field vectors in the TEz mode extend also into the plate-like TM-mode dielectric core portion, the resonant frequency thereof becomes lower than the frequencies of the TEx mode and the TEy mode. However, as shown in FIGS. 1 to 2B, since the frequency-determining grooves 15 are provided, the effective permittivity for the TEz mode is reduced, and the resonant frequency of the TEz mode is thereby set higher than in the case shown in FIG. 6.

In addition, the diameter in the z-axis direction of the spherical TE-mode dielectric core portion 12 determines the resonant frequency of the TEx mode and the TEy mode, and the diameters in the x-axis direction and the y-axis direction determine the resonant frequency of the TEz mode. Therefore, by increasing the diameter in the z-axis direction of the TE-mode dielectric core portion 12 to be larger than the x-axis direction and the y-axis direction, the frequencies of the TEx mode and the TEy mode can be reduced.

As described above, depending on the size of the frequency-determining grooves 15 and the shape of the TE-mode dielectric core portion 12, the resonant frequency of the TEz mode can also be controlled to be relatively close to the resonant frequencies of the TEx mode and the TEy mode. Therefore, the overall configuration can be used as a quintuple-mode dielectric resonator apparatus.

Thus, the electromagnetic fields in the described individual TM and TE modes coexist in the central portion of the dielectric core 10, the central portion of the TM-mode dielectric core portion 11, and concurrently, the TE-mode dielectric core portion TE-mode dielectric core portion 12.

Figure 7A:
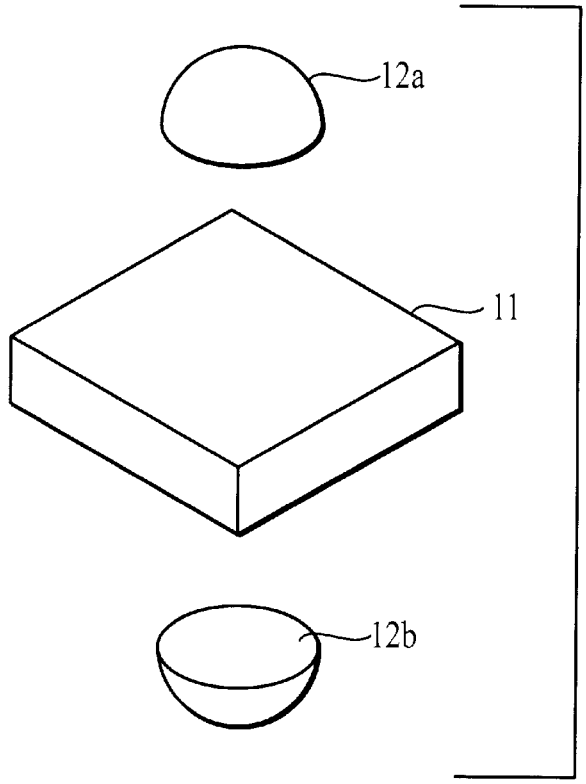
FIGS. 7A and 7B show the relationship between a TM-mode dielectric core portion and a TE-mode dielectric core portion.
Figure 7B:
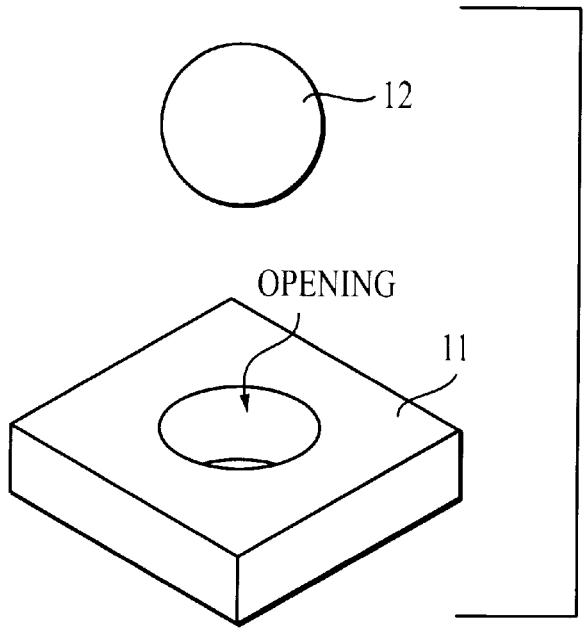

To view these two portions in more detail, as shown in FIG. 7A, they can be separated into a plate-like TM-mode dielectric core portion 11 and two hemispherical TE-mode dielectric core portions 12*a* and 12*b;* alternatively, as shown in FIG. 7B, they can be separated into a plate-like TM-mode dielectric core portion 11 having central opening and a spherical TE-mode dielectric core portion 12 to be inserted therein. In the case shown in FIG. 7A, TM-mode electric-field vectors extend to the TM-mode dielectric core portion 11. In the case shown in FIG. 7B, TE-mode electric-field vectors extend to the TE-mode dielectric core portion 12. It is to be noted that parts of the individual TM-mode dielectric core portion 11 and the TE-mode dielectric core portion 12 in the central portion of the dielectric core are shared by the TM modes and the TE modes.

Hereinbelow, referring to FIGS. 8A to 13B, a description will be given of configurations of multimode dielectric resonator apparatuses using other dielectric cores having different shapes. In each of FIGS. 8A to 13B, similarly to the type shown in FIGS. 2A and 2B, figures having the reference symbol "A" attached thereto are top views, and figures having the reference symbol "B" attached thereto are cross-sectional views thereof.

Figure 8A:
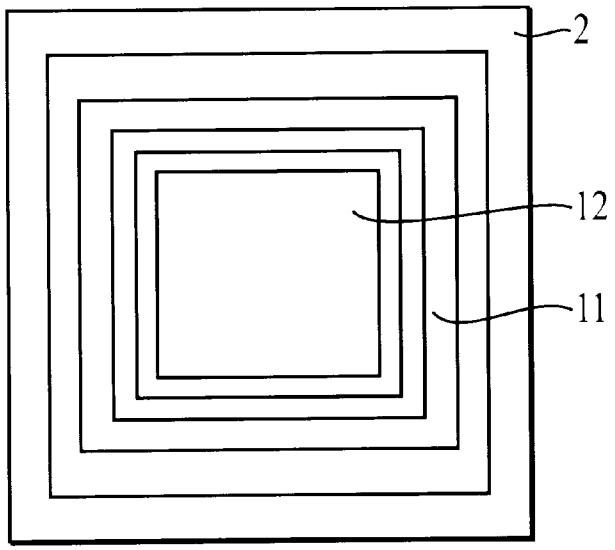
FIGS. 8A and 8B show another example of a shape of the TE-mode dielectric core portion.
Figure 8B:
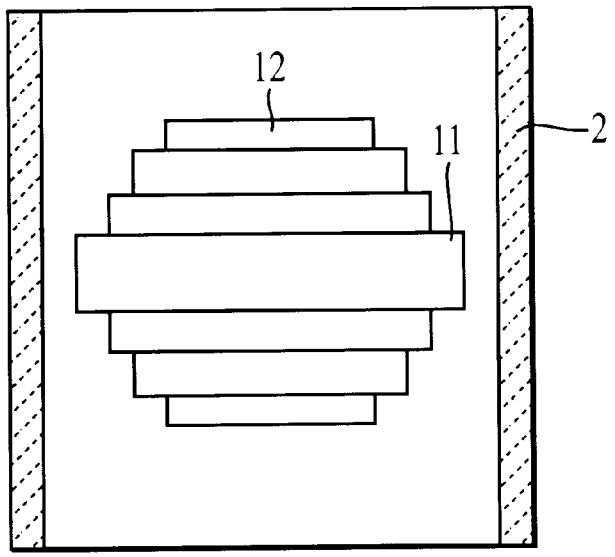

In an example shown in FIGS. 8A and 8B, a TE-mode dielectric core portion 12 is provided to have the shape of a stepped pyramid. That is, a four-sided pyramid-like shape is formed by steps in the upper and lower direction from the TM-mode dielectric core portion 11.

Figure 9A:
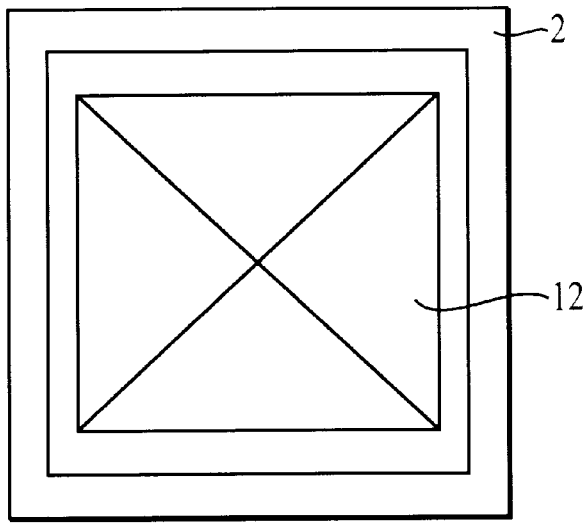
FIGS. 9A and 9B show still another example of a shape of the TE-mode dielectric core portion.
Figure 9B:
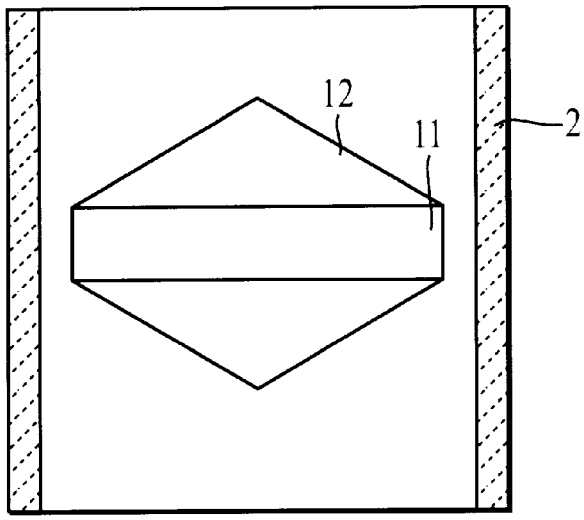
Figure 10A:
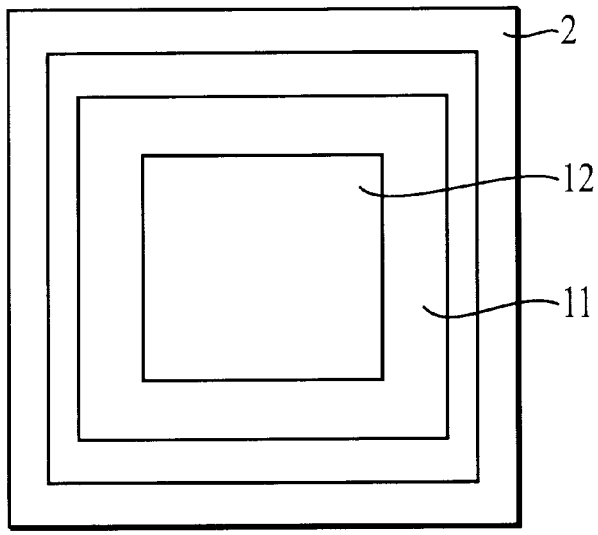
FIGS. 10A and 10B show still another example of a shape of the TE-mode dielectric core portion.
Figure 10B:
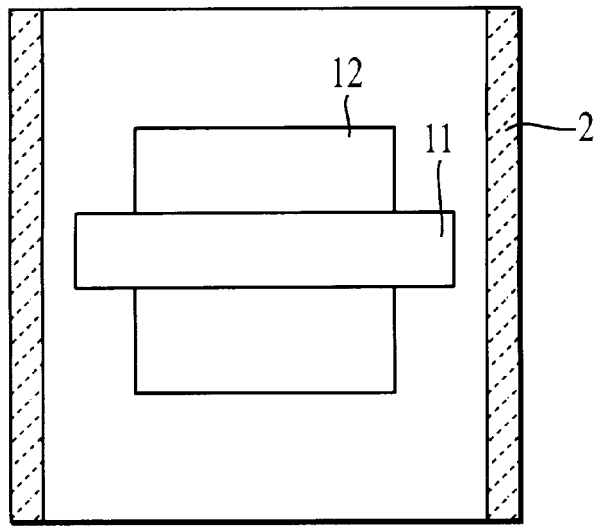
Figure 11A:
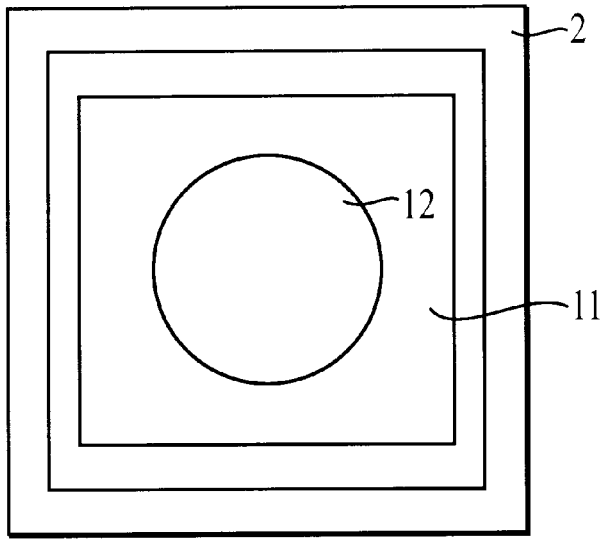
FIGS. 11A and 11B show still another example of a shape of the TE-mode dielectric core portion.
Figure 11B:
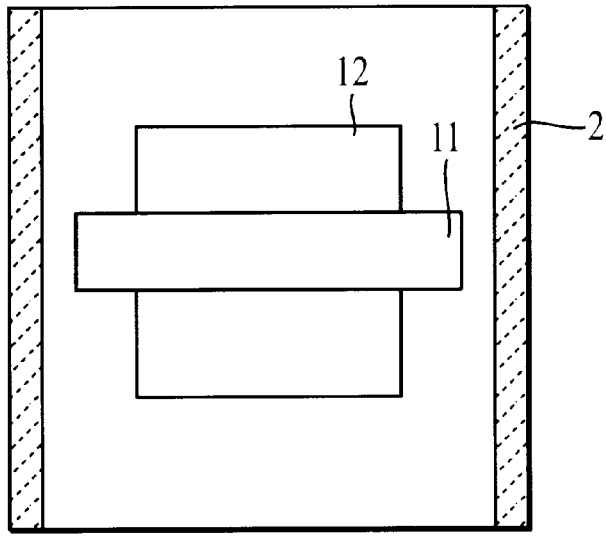
Figure 12A:
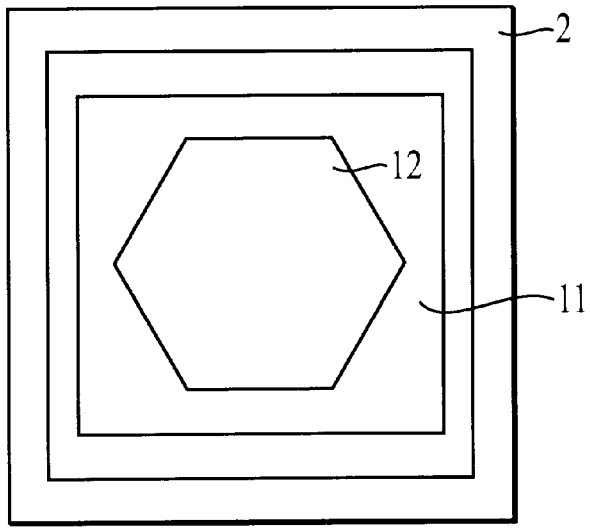
FIGS. 12A and 12B show still another example of a shape of the TE-mode dielectric core portion.
Figure 12B:
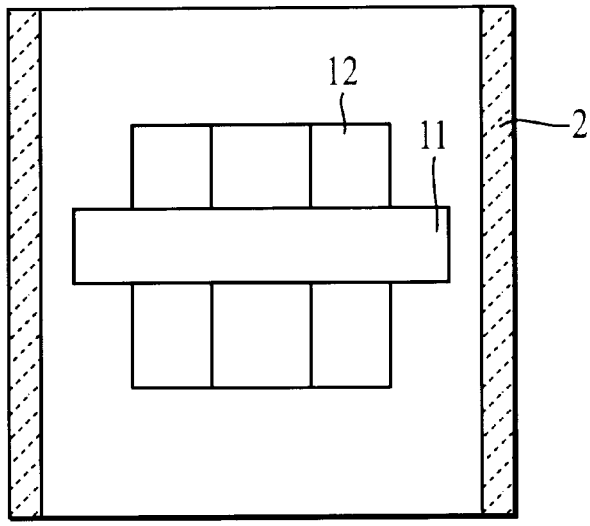
Figure 13A:
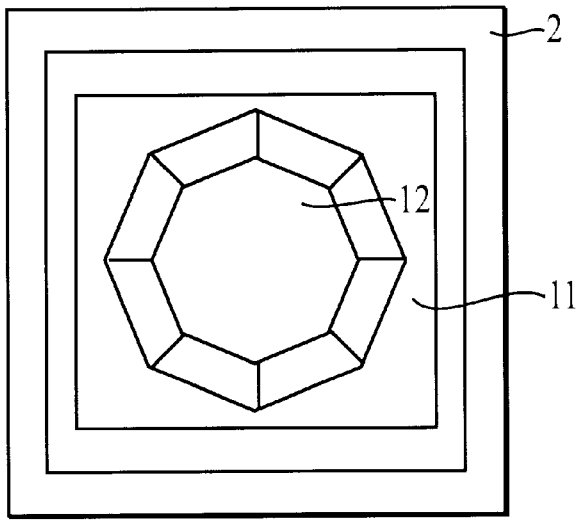
FIGS. 13A and 13B show still another example of a shape of the TE-mode dielectric core portion.
Figure 13B:
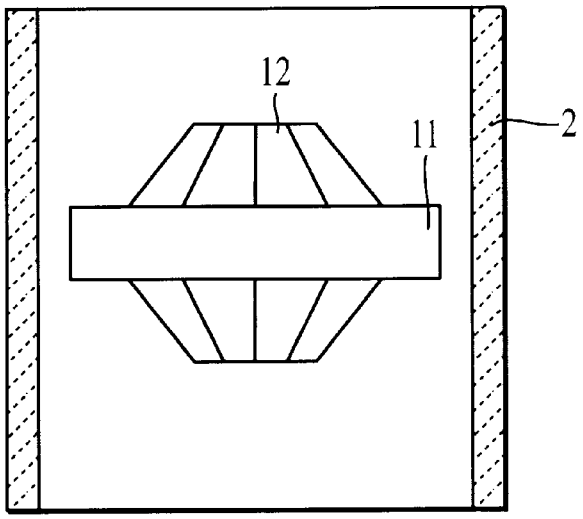

In an example shown in FIGS. 9A and 9B, a TE-mode dielectric core portion 12 having the shape of a four-sided pyramid is formed to protrude on the upper and lower sides of the TM-mode dielectric core portion 11. In an example shown in FIGS. 10A and 10B, a TE-mode dielectric core portion 12 having the shape of a four-sided column is formed to protrude on the upper and lower sides of the TM-mode dielectric core portion 11. In an example shown in FIGS. 11A and 11B, a TE-mode dielectric core portion 12 having the shape of a circular column is formed to protrude on the upper and lower sides of the TM-mode dielectric core portion 11. In an example shown in FIGS. 12A and 12B, a TE-mode dielectric core portion 12 having the shape of a hexagonal column is formed to protrude on the upper and lower sides of the TM-mode dielectric core portion 11. In an example shown in FIGS. 13A and 13B, a TE-mode dielectric core portion 12 having the shape of an octagonal column is formed to protrude on the upper and lower sides of the TM-mode dielectric core portion 11. In addition to the above, for example, a polyhedral protruding portion having another shape, such as a polyhedral column, a polyhedral pyramid, and a polyhedral trapezoid may be used as a TE-mode dielectric core portion.

With any one of these shapes, the plate-like TM-mode dielectric core portion 11 and the cavity 2 mainly function as a resonator in the TMx mode and the TMy mode. Also, the TE-mode dielectric core portion 12 mainly functions as a resonator in the TEx mode, TEy mode, and TEz modes.

Figure 14A:
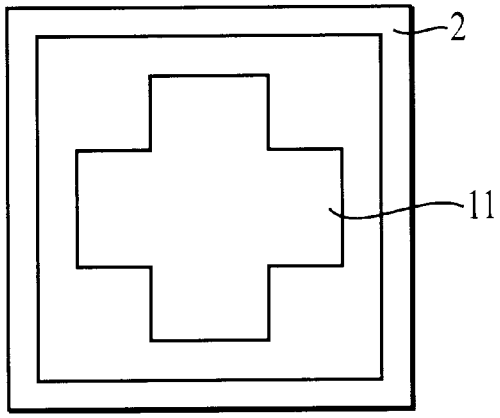
FIGS. 14A to 14C individually show examples of shapes of the TM-mode dielectric core portion.
Figure 14B:
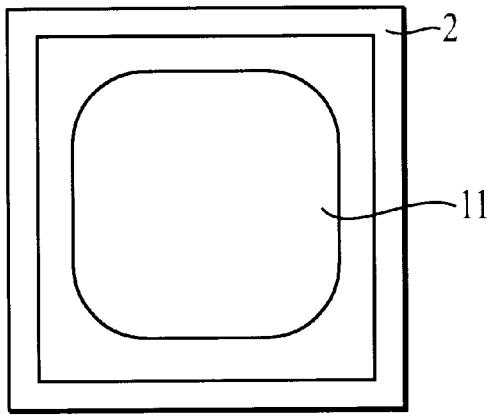
Figure 14C:
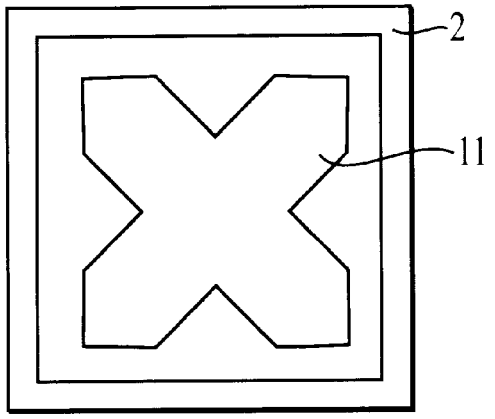

FIGS. 14A to 14C are plan views showing examples of TM-mode dielectric core portions 11 having other shapes. In the example in FIG. 14A, four corners of a plate-like portion are concave. In the example shown in FIG. 14B, four corners are rounded. In the example shown in FIG. 14C, the central portion of an each side is concave and tapered.

As shown in FIGS. 14A to 14C, by reducing the surface areas where end faces of the TM-mode dielectric core oppose inner wall faces of a cavity 2, the electrostatic capacitances therebetween are reduced. Therefore, the frequencies of the TMx mode and the TMy mode can be increased. Also, as shown in FIG. 14C, by cutting out part of the central portion of each side of a square-plate-like portion, the resonant frequency of the TEz modes can be increased. In this way, depending on the shape of the plate-like TM-mode dielectric core, the frequencies of the two TM modes and the TEz mode can be individually determined.

Hereinbelow, referring to FIGS. 15A to 18B, a description will be given of other examples of supporting structures for individual dielectric cores in individual cavities 2. In each of FIGS. 15A to 18B, as in FIGS. 2A and 2B, figures having the reference symbol "A" attached thereto are top views, and figures having the reference symbol "B" attached thereto are cross-sectional views thereof.

Figure 15A:
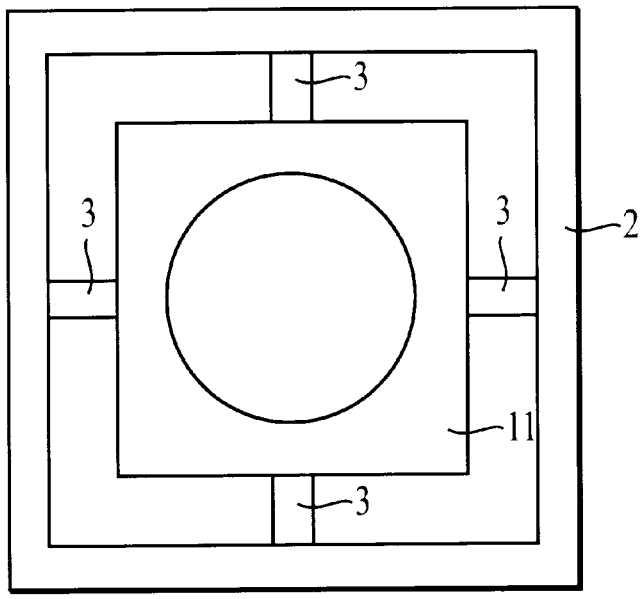
FIGS. 15A and 15B show an example of a support structure for a dielectric core in a cavity.
Figure 15B:
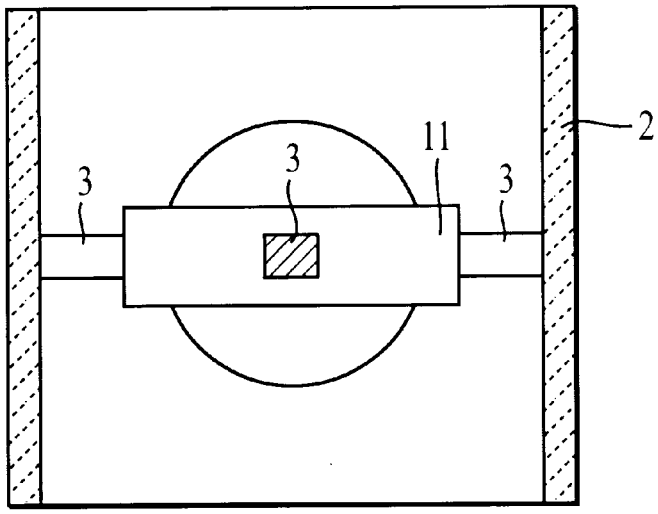
Figure 16A:
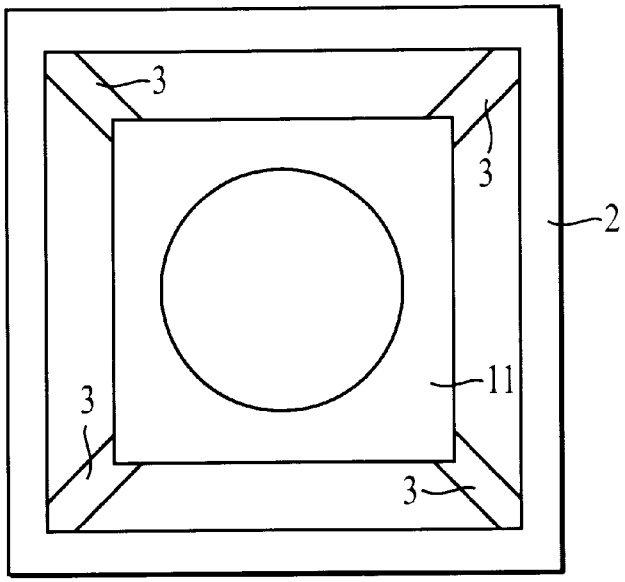
FIGS. 16A and 16B show another example of a support structure for a dielectric core in a cavity.
Figure 16B:
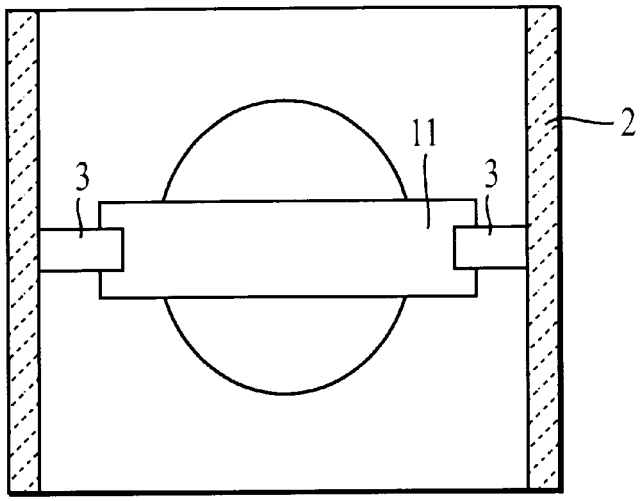
Figure 17A:
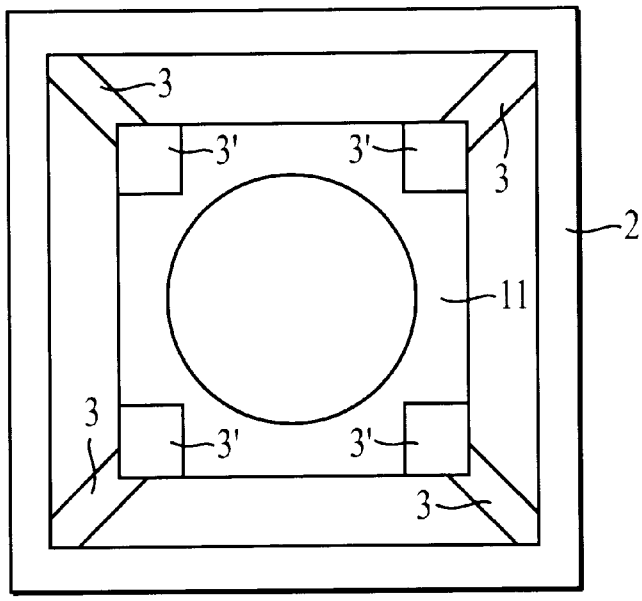
FIGS. 17A and 17B show still another example of a support structure for a dielectric core in a cavity.
Figure 17B:
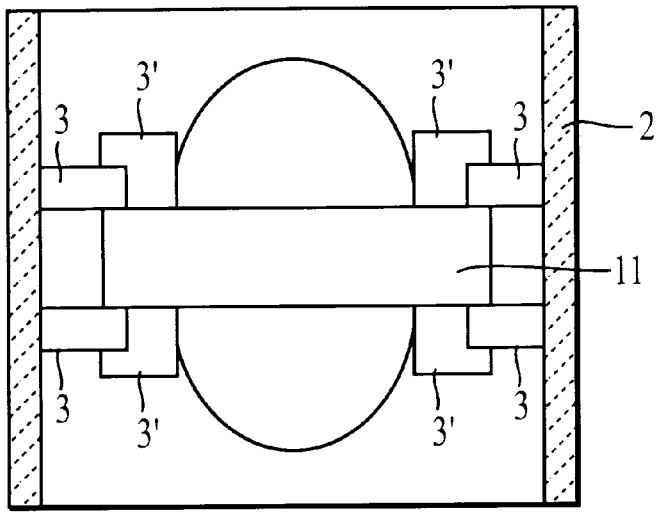
Figure 18A:
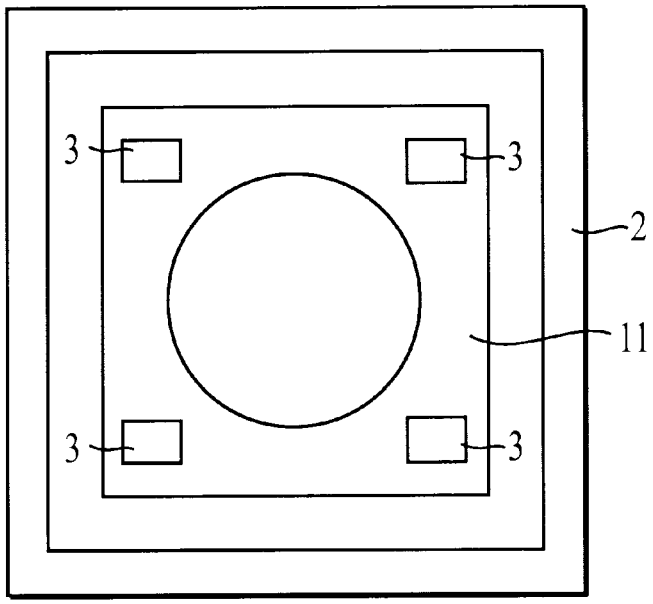
FIGS. 18A and 18B show still another example of a support structure for a dielectric core in a cavity.
Figure 18B:
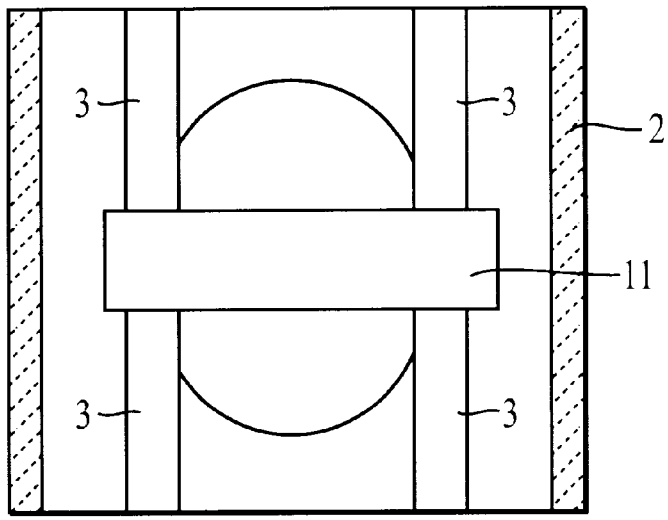

In the example shown in FIGS. 15A and 15B, the central portion of an individual end face of a TM-mode dielectric core portion 11 of the dielectric core is supported by a support member 3. In the example shown in FIGS. 16A and 16B, four corners of a TM-mode dielectric core portion 11 of the dielectric core are individually supported by support members 3. In the example shown in FIGS. 17A and 17B, support members 3' are individually fitted to upper and lower faces of four corners of a TM-mode dielectric core portion 11, and portions of the support members 3' are supported by support members 3 in the cavity 2. In the example shown in FIGS. 18A and 18B, a support member 3 is provided between the opening of the cavity 2 and the upper and lower faces in the vicinity of each of four corners of a TM-mode dielectric core portion 11. By using materials having permittivities lower than that of the dielectric core for these support members 3 and 3', influences therefrom on the individual resonant modes are reduced.

Hereinbelow, referring to FIGS. 19A and 19B, a description will be given of an example of a filter in which the above-described five resonant modes are sequentially coupled to each other.

Figure 19A:
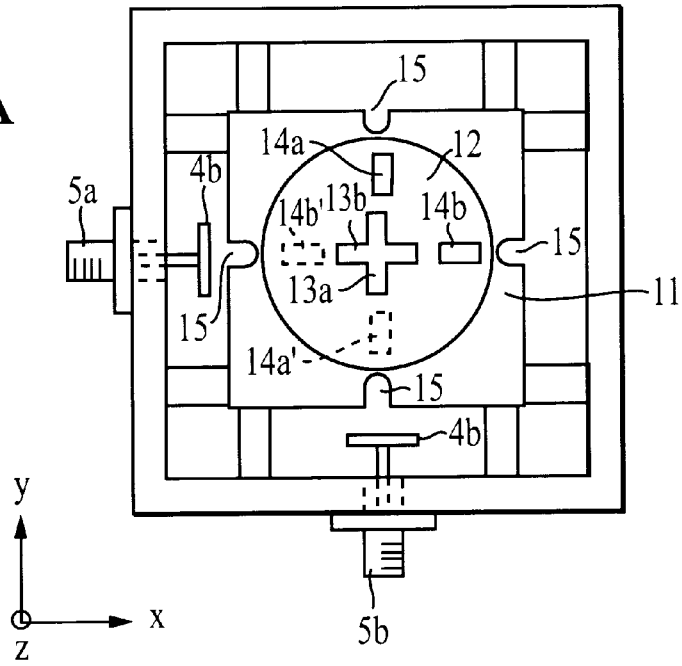
FIGS. 19A and 19B show an example of a filter using a quintuple mode resonator configured with the individual modes sequentially coupled to each other.
Figure 19B:
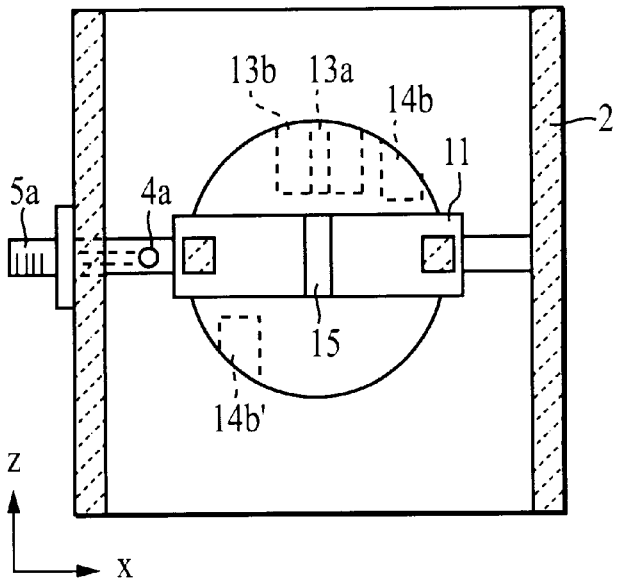

In FIGS. 19A and 19B, reference symbols 5*a* and 5*b* each denote a coaxial connector, and probes 4*a* and 4*b* each jutting out in a cavity 2 are fitted to central conductors thereof. Reference symbol 13*a* denotes a coupling groove for coupling a TMx mode and a TEy mode, and reference symbol 13*b* denotes a coupling groove for coupling the TMy mode and the TEx mode together. Reference symbols 14*a* and 14*a'* denote coupling grooves for coupling the TEy mode and a TEz mode together, and in addition, reference symbols 14*b* and 14*b'* denote coupling grooves for coupling the TEx mode and the TEz mode together.

Figure 20A:
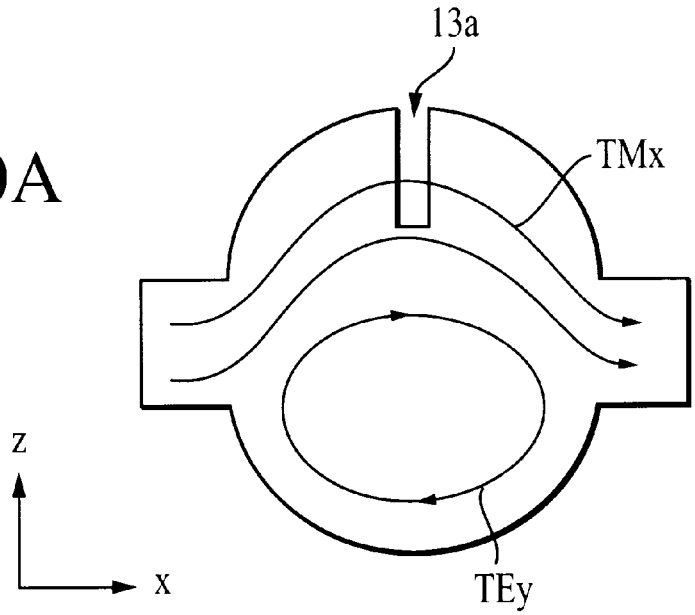
FIGS. 20A and 20B individually show states of coupling between TM modes and TE modes.
Figure 20B:
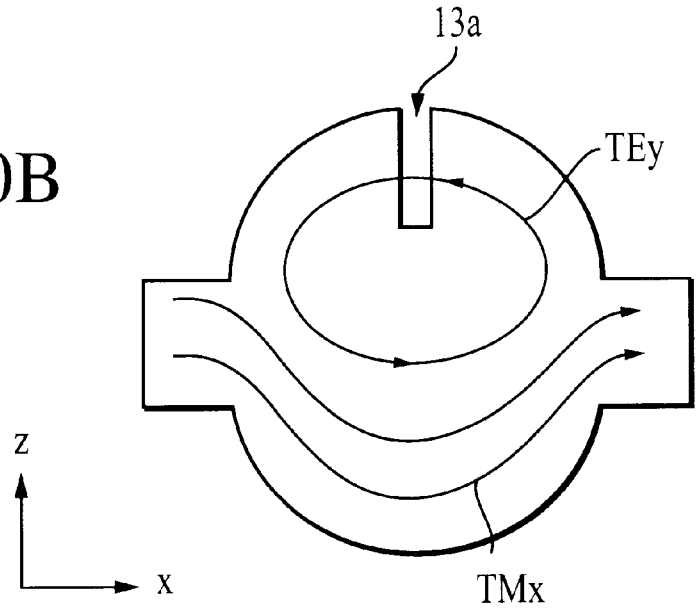

FIGS. 20A and 20B illustrate the operation of the coupling groove 13*a*. In these figures, curved lines with arrows represent electric-field vectors in the TMx mode and the TEy mode. The modes shown in FIG. 20A are assumed to be an even mode, and the modes shown in FIG. 20B are assumed to be an odd mode. The coupling groove 13*a* provides perturbations to field-intensity distributions in two modes. Thus, energy is transferred between the TMx mode and the TEy mode, and the two modes are coupled together. Similarly, as shown in FIGS. 19A and 19B, by providing the coupling groove 13*b* extending in the x-axis direction, the TMy mode and the TEx mode are coupled together.

Figure 21A:
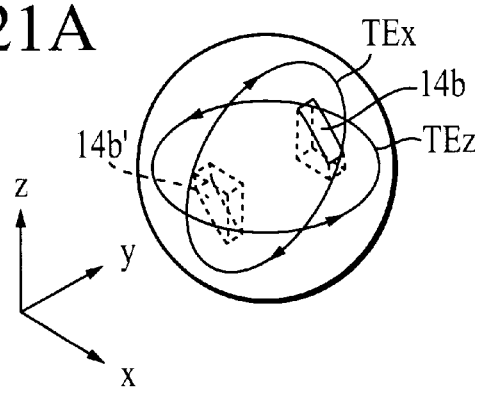
FIGS. 21A to 21D individually show states of coupling between TE modes.
Figure 21B:
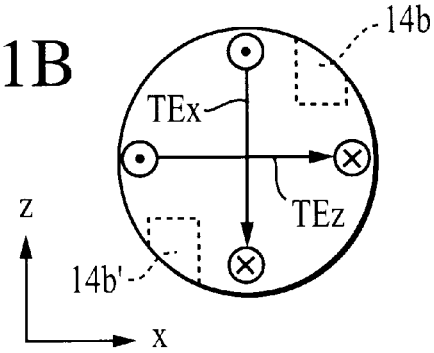
Figure 21C:
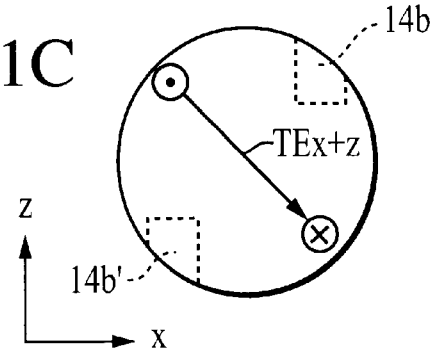
Figure 21D:
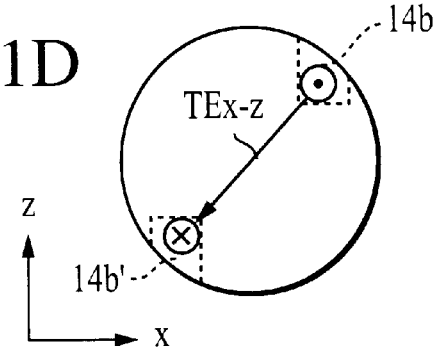

FIGS. 21A to 21D individually illustrate operations of the above-described coupling grooves 14 and 14'. FIG. 21A is a perspective view illustrating electricfield vectors in the TEx mode and the TEz mode. FIG. 21B shows electric-field vectors in the two modes in an x-z-plane cross section. In this case, when a sum mode of the TEx mode and the TEz mode (that is, the TEx+z mode) is considered, the mode forms a loop in a plane perpendicular to the x+z axis direction, as shown in FIG. 21C. Also, as shown in FIG. 21D, a vector in a difference mode between the TEx mode and the TEz mode (that is, the TEx−z mode) forms a loop in a plane perpendicular to the x−z axis direction.

The coupling grooves 14*b* and 14*b*' exist in a position where the electric-field vector in the TEx−z mode passes through. Therefore, they function to reduce the intensity of the electric field in the TEx−z mode, and the TEx mode and the TEz mode are coupled together by using the perturbations thereby generated. Similarly, in FIGS. 19A and 19B, the coupling grooves 14*b* and 14*b*' provide perturbations to a TEy+z mode and a TEy−z mode, thereby allowing the TEy mode and the TEz mode to couple together.

Thus, TMx-mode→TEy-mode coupling is caused by the coupling groove 13*a*, TEy-mode→TEz-mode coupling is caused by the coupling groove 14*b*, and in addition, TEx-mode→TMy-mode coupling is caused by the coupling groove 13*b*. Therefore, the configuration functions as a quintuple-mode resonator in which five resonators are serially coupled to each other.

In FIGS. 19A and 19B, the probe 4*a* is coupled by electric fields to the TMx mode, which is a first-stage resonator; and the probe 4*b* is couple by electric fields to a TMy mode, which is a last-stage resonator. In this manner, the portion between the coaxial connectors 5*a* and 5*b* forms a filter presenting characteristics of a band-pass filter using five stages of resonators.

Hereinbelow, referring to FIGS. 22A to 22B, a description will be given of an example in which individual modes among the above-described five resonant modes are coupled, and predetermined modes are rotated by 45 degrees in the xy plane.

Figure 22A:
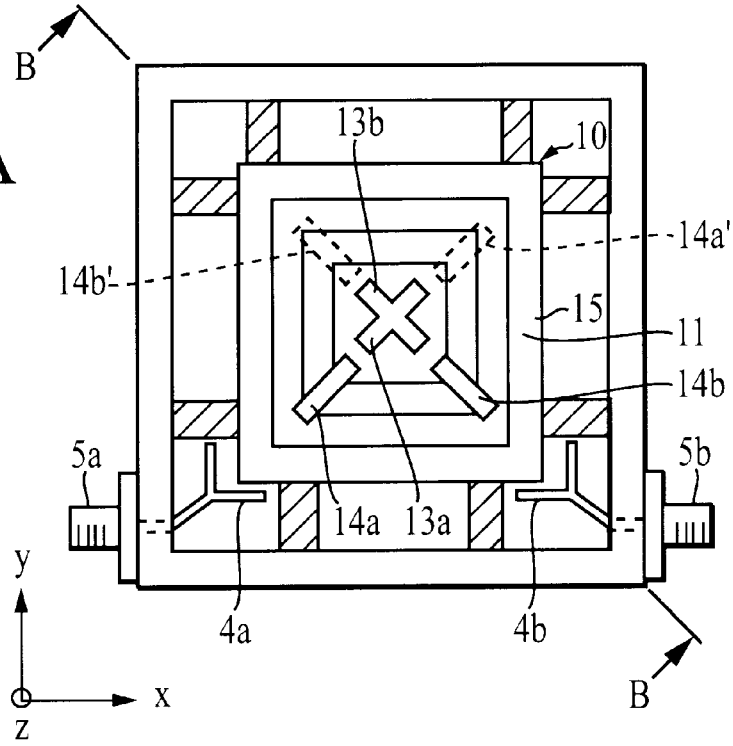
Figure 22B:
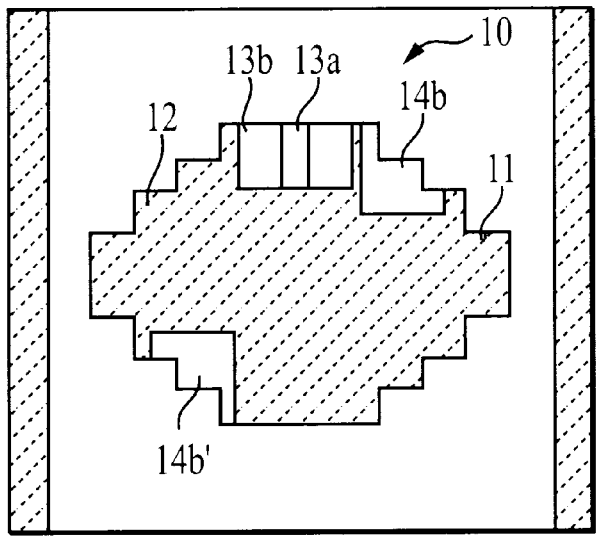

In the structure, shown in FIGS. 22A and 22B, various modes are generated. A TM-mode dielectric core portion 11 generates a TMx+y mode in which electric-field vectors extend in the direction of the x+y axis and a TMx−y mode in which electric-field vectors extend in the direction of the x−y axis. On the other hand, a TE-mode dielectric core portion 12 generates a TEx+y mode in which an electric-field vector forms a loop in a plane perpendicular to the x+y axis direction, a TEx−y mode in which an electric-field vector forms a loop in a plane perpendicular to the x−y axis direction, and in addition, a TEz mode in which an electric-field vector forms a loop in a plane perpendicular to the z-axis direction.

Therefore, the apparatus as described above is similar to an apparatus having a construction equivalent to the construction shown in FIGS. 19A and 19B that is rotated by 45 degrees in the xy plane. In this construction, a coupling groove 13*b* causes the TMx+y mode and the TEx−y mode to couple together, and a coupling groove 13*a* causes the TMx−y mode and the TEx+y mode to couple together. Also, a coupling groove 14*a* causes the TEx+y mode and the TEx−y mode to couple together, and a coupling groove 14*b* causes the TEx−y mode and the TEz mode to couple together. Also, a probe 4*a* couples to the TMx+y mode in the electric field, and a probe 4*b* couples to the TMx−y mode in the electric field. As described above, in a manner similar to that shown in FIGS. 19A and 19B, the portion between coaxial connectors 5*a* and 5*b* forms a filter having characteristics of a band-pass filter using five resonator stages sequentially coupled to each other.

Figure 23A:
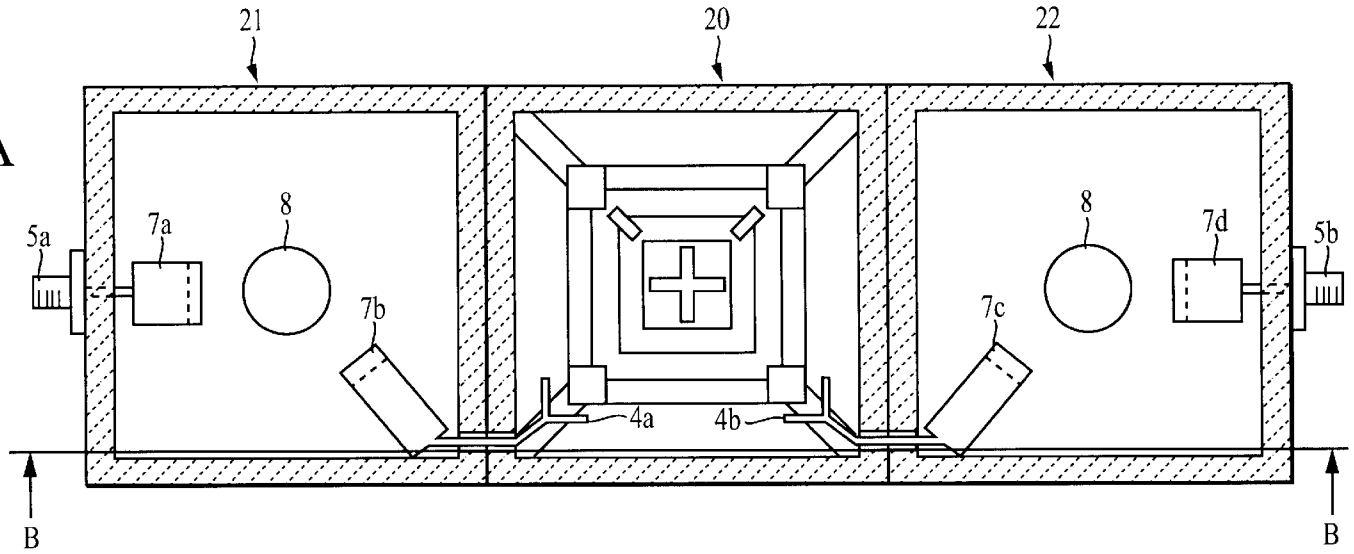

Hereinbelow, referring to FIGS. 23A and 23B, a description will be given of an example of a filter configuration formed by combining other resonators with the multimode dielectric resonator apparatus shown in FIGS. 22A and 22B. FIG. 23A is an upper view of a state where an upper cover is removed, and FIG. 23B is a cross-sectional view of the portion B—B in FIG. 23A.

Figure 23B:
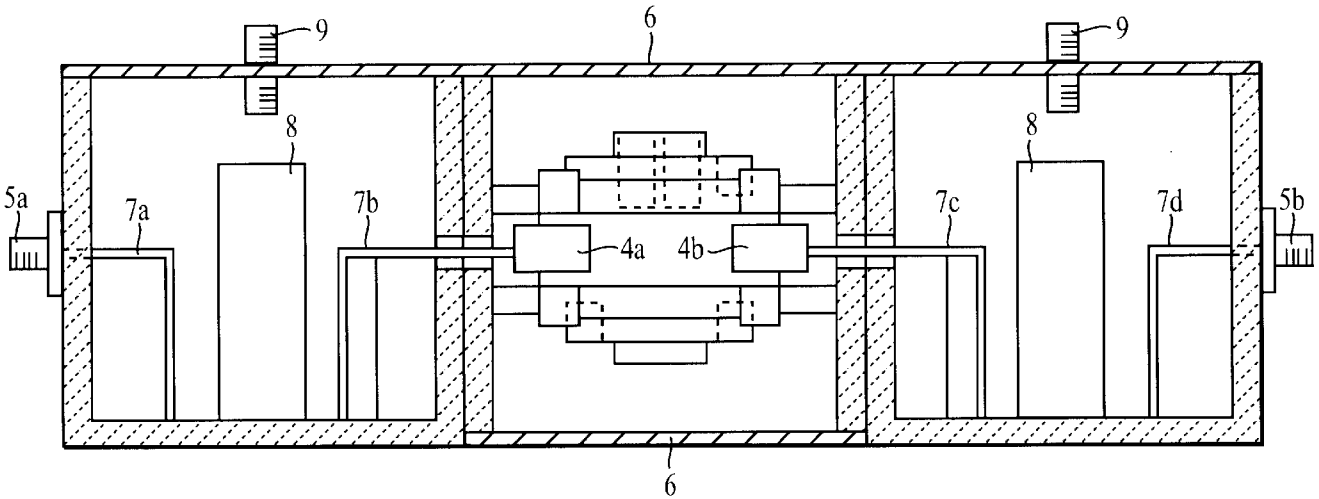

In FIGS. 23A and 23B, reference numeral 20 denotes the quintuple mode resonator shown in FIGS. 22A and 22B; and reference numerals 21 and 22 each denote a semicoaxial resonator. The individual semicoaxial resonators 21 and 22 have a central conductor 8 in a cavity 2, and the resonant frequency is determined according to electrostatic capacitance generated between a lower end portion of a frequency-modulating screw 9 and an upper end portion of the central conductor 8, the length of the central conductor 8, and other components.

A coupling loop 7*a* is provided between a central conductor of a coaxial connector 5*a* and an inner face of the cavity 2, and external coupling is made through the coupling loop 7*a*. Similarly, a coupling loop 7*d* is provided between a central conductor of a coaxial connector 5*b* and an inner face of the cavity 2, and external coupling is made through the coupling loop 7*d*. Coupling loops 7*b* and 7*c* are connected to the probes 4*a* and 4*b*, respectively; and the coupling loops 7*b* and 7*c* are connected by magnetic fields to the semicoaxial resonators 21 and 22, respectively.

The above-described configuration, which has the first and last resonator stages and five dielectric resonator stages therebetween, operates as a filter that has a total of seven resonator stages and that has band-pass characteristics. As described above, since the first and last resonator stages are semicoaxial resonators, and strong coupling is obtained by the coupling loops, broad-band characteristics can be easily obtained. In addition, since the spurious mode due to the quintuple mode resonator 20 are minimized by the semicoaxial resonators 21 and 22, the overall spurious characteristics are improved. Furthermore, since direct coupling to the outside is not necessary, the probes 4*a* and 4*b* in the quintuple mode resonator 20 can be small, direct passage of signals between the input and the output is reduced, and deterioration in the characteristics of the filter due to the direct passage is therefore not caused. In the example shown in FIGS. 23A and 23B, although semicoaxial resonators are used, coaxial resonators can be similarly used for the first stage and the last stage. In this alternative example, similar effects can be obtained.

Hereinbelow, referring to FIG. 24, a description will be given of an example of a configuration of a duplexer.

Figure 24:
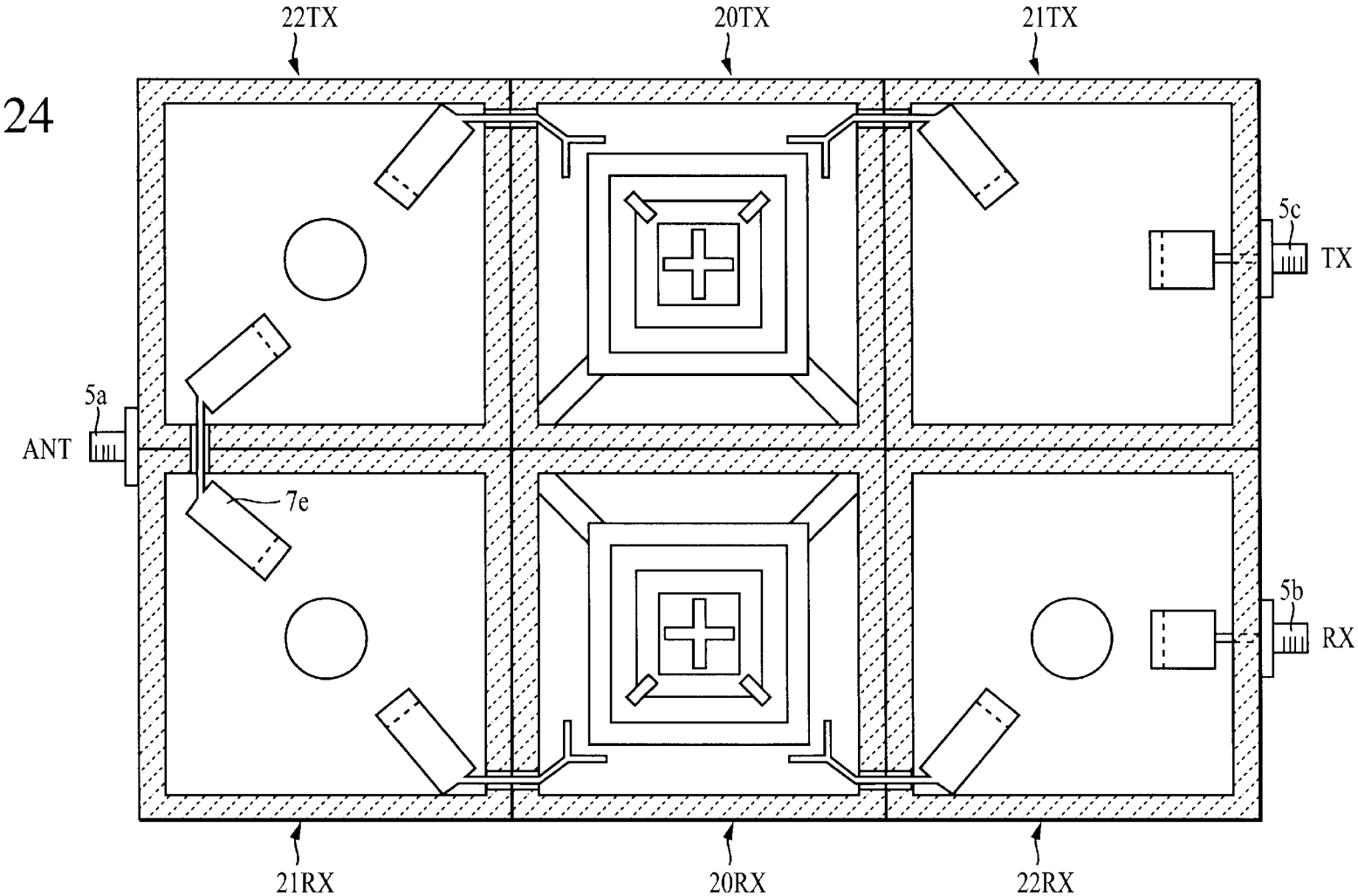
FIG. 24 shows an example of a configuration of a duplexer.

In FIG. 24, reference symbols 20TX and 20RX denote quintuple mode resonators that are similar to those shown in FIGS. 22A and 22B; and reference symbols 21TX, 22TX, 21RX, and 22RX denote semicoaxial resonators that are similar to those shown in FIGS. 23A and 23B. A transmission filter portion is comprises the two semicoaxial resonators 21TX and 22TX and the quintuple mode resonator 20TX. Similarly, a reception filter portion comprises the two semicoaxial resonators 21RX and 22RX and the quintuple mode resonator 20RX.

Coupling loops 7*e* connected to a central conductor of a coaxial connector 5*a* are individually coupled by magnetic fields to the semicoaxial resonators 22TX and 21RX, and transmission signals and reception signals are thereby separated. Thus, the duplexer is usable as an antenna-sharing apparatus.

Figure 25:
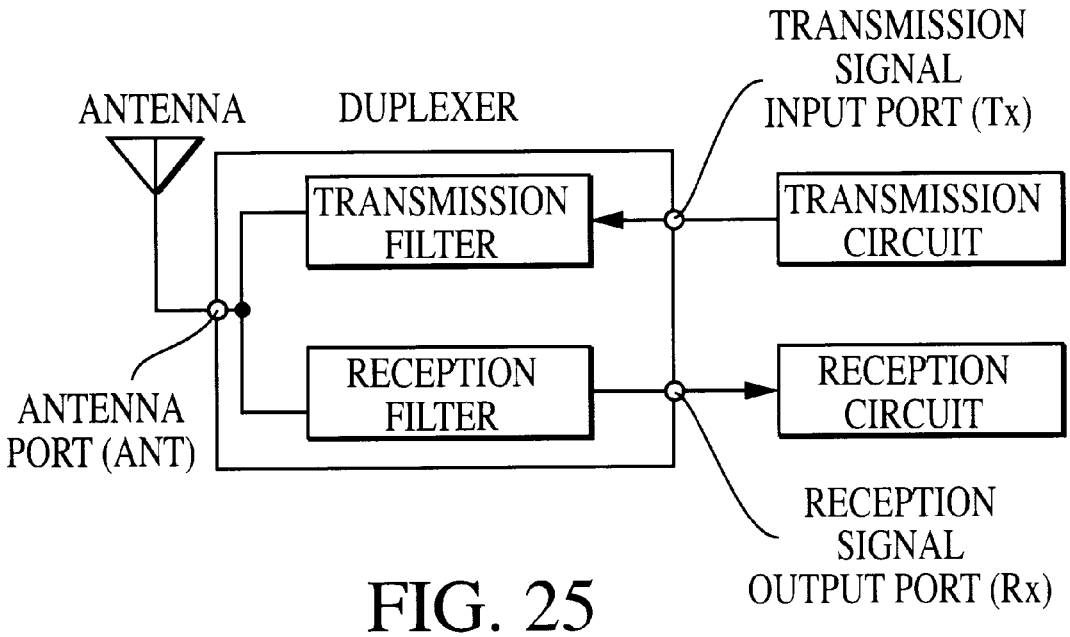
FIG. 25 is a schematic view showing a configuration of a communication apparatus.

FIG. 25 is a schematic block diagram of a communication apparatus in which the above-described duplexer is used. As shown in the figure, a transmission circuit and a reception circuit are connected to an input port of the transmission filter and an output port of the reception filter, respectively. Also, an antenna is connected to the input port of the reception filter and the output port of the transmission filter. This allows a high frequency section of the communication apparatus to be configured.

In addition to the described example, the above-described quintuple mode resonator may be used as an independent bandpass filter.

In the individual embodiments, description has been made with reference to the examples in which the TMx mode and the TMy mode are generated in the square plate-like portion of the dielectric core, and both are used. However, the arrangement may be such that, by using a rectangular plate-like TM-mode dielectric core, for example, only the TMx mode resonates in an operating frequency band, and the resonant frequencies of the TMy mode and the TMz mode are increased to be higher than the operating frequency band, so that only the single TM mode is used.

Also, although the three TE modes are used in the embodiments, the arrangement may be such that only two TE modes thereof are used.

As described above, although the present invention has been described referring to specific embodiments, examples, and modifications, it is not limited thereto. On the contrary, the present invention is intended to cover various other modifications and equivalent arrangements within the spirit and scope of the invention.

What is claimed is:

1. A multimode dielectric resonator apparatus comprising a dielectric core arranged in a conductive cavity, the dielectric core comprising:

a TM-mode dielectric core portion which determines resonant frequencies of TM modes so that at least one TM mode resonates in an operating frequency band; and a TE-mode dielectric core portion which determines resonant frequencies of TE modes so that multiple TE modes resonate in the operating frequency band, wherein the TM-mode dielectric core portion is formed with a plate-shape, and the TE-mode dielectric core portion is formed by a pair of portions protruding respectively from an upper face and a lower face of the plate-shaped portion.

2. The multimode dielectric resonator apparatus as stated in claim 1, wherein the TM-mode and TE-mode dielectric core portions are integrated together.

3. A filter comprising:

the multimode dielectric resonator apparatus as defined in one of claims 1 and 2, and input/output connectors coupled to predetermined resonant modes in the multimode dielectric resonator apparatus.

4. A communication apparatus comprising the filter as defined in claim 3, and further comprising one of a transmitting circuit and a receiving circuit connected to said filter.

5. The filter as defined in claim 3, wherein said input/output connectors are coupled to TM modes; and further comprising coupling structures at said dielectric core which couple TM modes and TE modes to each other; and coupling structures at said dielectric core which couple TE modes to each other.

6. A duplexer comprising first and second filters, each being a filter according to claim 3, and each filter having an input connector and an output connector;

the input connector of the first filter serving as a transmitter input terminal, the output connector of the second filter serving as a receiver output terminal, and the output connector of the first filter and the input connector of the second filter being connected in common to an antenna terminal.

7. A communication apparatus comprising the duplexer as defined in claim 6, and further comprising a transmitting circuit connected to said transmitter input terminal, and a receiving circuit connected to said receiver output terminal.

8. A filter comprising:

the multimode dielectric resonator apparatus as defined in one of claims 1 and 2, coaxial resonators or semicoaxial resonators that are coupled to predetermined modes of said multimode dielectric resonator apparatus, and input/output connectors coupled to the coaxial or semicoaxial resonators.

9. A communication apparatus comprising the filter as defined in claim 8, and further comprising one of a transmitting circuit and a receiving circuit connected to said filter.

10. A duplexer comprising first and second filters, each being a filter according to claim 8, and each filter having an input connector and an output connector;

the input connector of the first filter serving as a transmitter input terminal, the output connector of the second filter serving as a receiver output terminal, and the output connector of the first filter and the input connector of the second filter being connected in common to an antenna terminal.

11. A communication apparatus comprising the duplexer as stated in claim 10, and further comprising a transmitting circuit connected to said transmitter input terminal, and a receiving circuit connected to said receiver output terminal.

* * * * *